United States Patent [19]

Konishi et al.

[11] Patent Number: 4,837,535

[45] Date of Patent: Jun. 6, 1989

[54] RESONANT WAVE FILTER

[75] Inventors: Yoshihiro Konishi, Sagamihara; Kenichi Konno, Machida; Ikuo Awai, Ichikawa, all of Japan

[73] Assignee: Uniden Corporation, Ichikawa, Japan

[21] Appl. No.: 293,666

[22] Filed: Jan. 5, 1989

[51] Int. Cl.[4] ..... H01P 1/208; H01P 1/205; H01P 1/20

[52] U.S. Cl. ..... 333/210; 333/206; 333/212

[58] Field of Search ..... 333/202, 206–212, 333/245, 248, 134–136, 219, 219.1, 222–233

[56] References Cited

U.S. PATENT DOCUMENTS 4,626,809 12/1986 Mizumura et al. ..... 333/210 X

*Primary Examiner*—Marvin L. Nussbaum

*Attorney, Agent, or Firm*—Oblon, Spivak, McClelland, Maier & Neustadt

[57] ABSTRACT

A compact resonant wave filter capable of selectively propagating an electromagnetic wave of a prescribed frequency with excellent band-pass wave filter characteristics comprises a TM mode resonator disposed perpendicularly to the direction of propagation of electromagnetic wave energy, a pair of TEM mode resonators disposed one on either side or said TM mode resonator in the direction of propagation of electromagnetic wave energy, and a pair of cutoff waveguides disposed one between said TEM mode resonator and each of said TM mode resonators to couple said TEM mode resonator with said TM mode resonators in evanescent mode.

8 Claims, 4 Drawing Sheets

RESONANT WAVE FILTER

BACKGROUND OF THE INVENTION

1. Field of the Invention

This invention relates to a resonant wave filter consisting of a plurality of cascade-coupled resonators of the type commonly used in microwave communication equipment and, more particularly, to a resonant wave filter which can be made compact in size without loss of performance.

2. Prior Art Statement

As a resonant wave filter of the aforesaid type for use in microwave communication equipment, there has up to now been exclusively used the coaxial dielectric resonant wave filter. As shown in FIG. 8(*a*), for enhanced compactness, this conventional resonant wave filter is constituted of quarter-wave coaxial resonators 1*a*, 1*b*, 1*c* having respective central conductors 2*a*, 2*b*, 2*c* and filled with dielectric material. As illustrated, the quarter-wave resonators 1*a*, 1*b*, 1*c* are, for example, arranged in parallel and sequentially capacity coupled. Where particularly sharp band filter characteristics are required, there has been used the waveguide dielectric resonator. In this resonator, square waveguide dielectric resonators 4*a*, 4*b*, 4*c* exhibiting high Q value are cascade-coupled via partitions 16, 17 as shown for example in FIG. 8(*b*).

While the coaxial dielectric resonator of FIG. 8(*a*) is compact, it cannot achieve a high Q value and thus is incapable of providing sufficiently sharp band filter characteristics. Moreover, since it employs capacitive coupling, it is structurally complex.

On the other hand, since in the waveguide dielectric resonant wave filter of FIG. 8(*b*) input/output coupling is achieved by inserting probes 14, 15 into the waveguide dielectric resonators 4*a*, 4*c*, these endmost resonators fail to provide the desired high Q value in spite of being large in size.

OBJECT AND SUMMARY OF THE INVENTION

An object of this invention is to provide a resonant wave filter for use with microwaves which overcomes the aforesaid problems and manifests the advantageous characteristics of both the coaxial and waveguide microwave resonant wave filters.

Another object of the invention is to provide such a resonant wave filter which has sufficiently sharp band filter characteristics and can be made compact without sacrificing performance.

For attaining these objects, the present invention provides a resonant wave guide filter comprising first and second TEM mode resonators cascade coupled in the direction of electromagnetic energy propagation, a TM mode resonator deposed between the cascade-coupled first and second TEM mode resonators to be perpendicular to the direction of electromagnetic propagation, and cutoff waveguides which couple the TEM mode resonators with the TM mode resonator in the evanescent mode.

The above and other features of the present invention will become apparent from the following description made with reference to the drawings.

BRIEF DESCRIPTION OF THE DRAWINGS

FIG. 4(*b*) is a schematic plan view of a third embodiment of the resonant wave filter according to this invention.

FIG. 5(*b*) is a sectional view taken along line V—V of FIG. 5(*a*).

FIG. 7(*b*) is a graph showing the broad-band response characteristics of the resonant wave filter of FIG. 6.

FIG. 8(*b*) is a plan view of another example of a conventional resonant microwave filter.

DETAILED DESCRIPTION OF THE PREFERRED EMBODIMENTS

Figure 3:
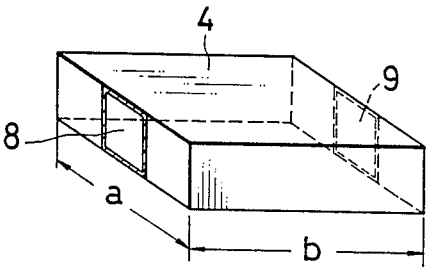
FIG. 3 is a perspective view of a waveguide resonator of the resonant wave filter of FIG. 1.

First the basic structure of the resonant wave filter for microwaves according to this invention will be explained with reference to FIG. 1. As illustrated, the resonant wave filter is provided at its opposite ends with quarter-wave coaxial resonators 1 and 6 having respective central conductors 2 and 7. The quarter-wave coaxial resonators 1 and 6 are capacitively fine-tuned and are respectively input and output coupled. In the center of the resonant wave filter, between the quarter-wave coaxial resonators 1 and 6, is provided a square waveguide resonator 4 which is of the same height as the resonators 1 and 6 and, as shown in FIG. 3, whose width a and length b are such as to make the square waveguide resonator 4 resonant at a desired frequency (resonant frequency $\lambda=2/\sqrt{(1/a+1/b)}$). The central resonator 4 is coupled with the end resonators 1 and 6 by respective square cutoff waveguides 3 and 5 which are of the same height as the resonators and of a width and a length selected to provide cutoff with respect a prescribed frequency.

Figure 2:
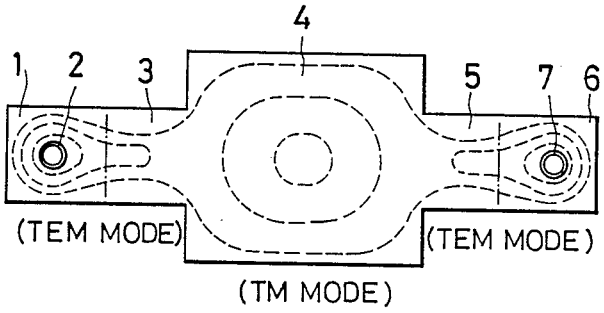
FIG. 2 is a plan view showing the operating mode of the resonant wave filter of FIG. 1.

When the resonators 1, 4 and 6 are sequentially coupled by the cutoff waveguides 3 and 5 in the illustrated manner, then, as shown in FIG. 2, evanescent mode magnetic coupling via the regions formed by the cutoff waveguide 3, 5 is obtained between the TEM mode magnetic field arising around the central conductors 2, 7 disposed perpendicularly to the direction of electromagnetic energy propagation in the coaxial resonators 1, 7 and the TM mode magnetic field in the central waveguide resonator 4, the axis of which also lies perpendicular to the direction of electromagnetic energy propagation. Therefore, if, for example, an input electromagnetic wave of a prescribed frequency is capacity coupled to the central conductor 2 of the resonator 1, the TEM mode magnetic field arising in the coaxial resonator 1 in response to the input electromagnetic wave will couple with the central waveguide resonator 4 causing a TM mode magnetic field to arise therein. This TM mode magnetic field in the waveguide resonator 4 will then couple with the coaxial resonator 6 to give rise to a TEM mode magnetic field around the central conductor 7. It therefore becomes possible to selectively extract an output electromagnetic wave of the desired frequency from the central conductor 7 through, for example, capacitive coupling. The arrangement thus functions as a band-pass resonant wave filter.

In evanescent mode magnetic coupling as shown in FIG. 2, the strength of the magnetic field produced around, for example, the central conductor 2 of the coaxial resonator 1 grows weaker with increasing distance from the central conductor 2. Therefore, the coupling strength between the TEM mode magnetic field in the coaxial resonator 1 and the TM mode magnetic field in the central waveguide resonator 4 varies with the length of the cutoff waveguide 3 interposed between these two resonators. This enables the sharpness of band-pass wave filter characteristics resulting from the sequential coupling of the resonators to be adjusted by varying the length of the cutoff waveguides 3 and 5 since this length affects the magnetic coupling strength.

Further, as will be understood from FIG. 3 showing the central waveguide resonator 4 of width a and length b, the magnetic coupling strength can be varied and the band-pass characteristics suppressed by varying the width of the coupling apertures 8 and 9 provided on the input and output sides, respectively, i.e. by varying the width of the cutoff waveguides 3 and 5.

Figure 8A:
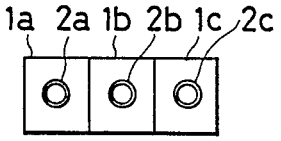
FIG. 8(a) PRIOR ART
FIG. 8(*a*) is a plan view of an example of a conventional resonant microwave filter.
Figure 8B:
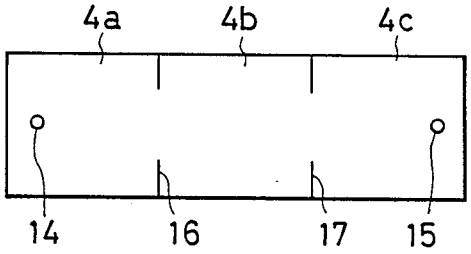
FIG. 8(b) PRIOR ART

In the case of a band-pass wave filter based on a plurality of cascade-coupled resonators for an electromagnetic wave of a specific velocity, it is possible to realize the desired high Q value for the waveguide resonator positioned in the middle but not for those at the ends. Specifically, in a conventional device of the type shown in FIG. 8(*b*) which is constituted solely of cascade-coupled waveguide resonators, since, as mentioned earlier, coupling with respect to an external circuit is accomplished by inserting probes, it is not possible to realize the desired high Q value in the end waveguide resonators 4*a*, 4*c* and, in fact, the level of the Q value which can be obtained is not substantially higher than that obtainable with coaxial resonators. In the case of the basic structure according to the present invention shown in FIG. 1, however, the problem of the intrinsically low Q value of waveguide resonators at the opposite ends is overcome by disposing the coaxial resonators 1, 6 at the ends and disposing the waveguide resonator 4 in the center, whereby it becomes possible to realize the sharp band wave filter characteristics obtainable at the high Q value that can be expected from a resonator of the waveguide type and at the same time to realize the size reduction that can be expected from the use of resonators of the coaxial type at the opposite ends where it is intrinsically difficult to realize a high Q value.

Figure 1:
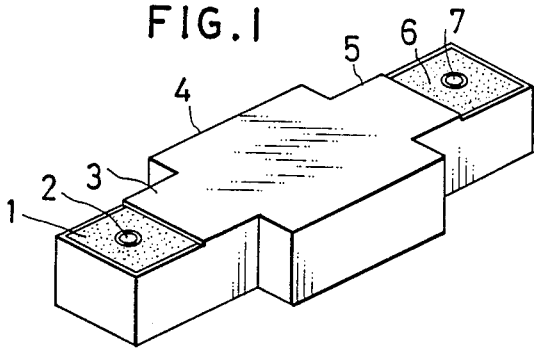
FIG. 1 is a perspective view of the basic structure of the resonant wave filter according to the present invention.
Figure 4A:
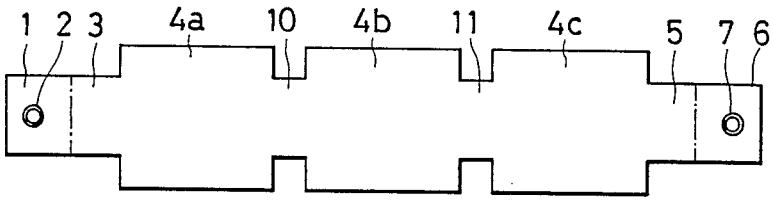
FIG. 4(*a*) is a schematic plan view of a second embodiment of the resonant wave filter according to this invention.
Figure 4B:
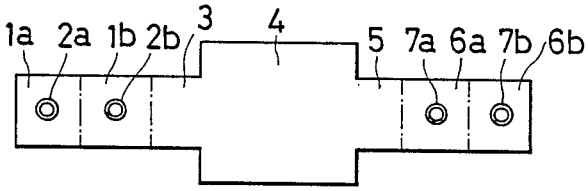

The resonant wave filter according to the present invention is not limited to the structure shown in FIG. 1 but may be realized by various different structures in line with the gist of the invention explained in the foregoing. For example, as shown in FIG. 4(*a*), the number of centrally disposed waveguide resonators can be increased to provide, for instance, three waveguide resonator stages 4*a*, 4*b*, 4*c* which are cascade-coupled in the order mentioned by cutoff waveguides 10 and 11, whereby the sharpness of the band-pass characteristics can be increased. Alternatively, as shown in FIG. 4(*b*), the number of coaxial resonators disposed at the ends can be increased to provide, for instance, two capacity-coupled coaxial resonator stages 1*a*, 1*b* at one end and two capacity-coupled coaxial stages 6*a*, 6*b* at the other end, whereby a compact resonant wave filter with the desired band-pass characteristics can be obtained.

Figure 5A:
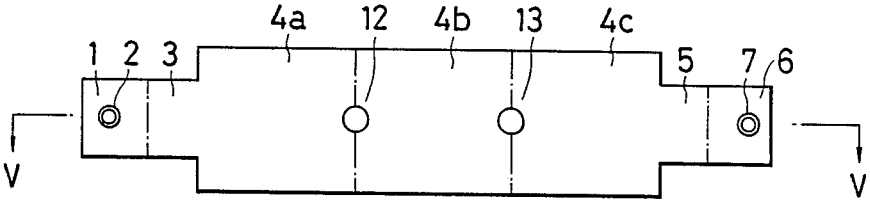
FIG. 5(*a*) is a schematic plan view of a fourth embodiment of the resonant wave filter according to this invention.
Figure 5B:
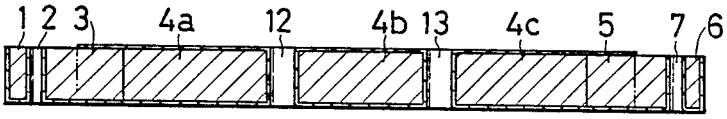

Further, as shown in FIG. 5, the cutoff waveguides 10 and 11 separating the three cascade-coupled waveguide resonator stages 4*a*, 4*b*, 4*c* of the embodiment of FIG. 4(*a*) can be eliminated and there can be provided conductor rods 12, 13 which pass through the internal space between the stages in a direction perpendicular to the direction of propagation of the electromagnetic energy. In this case, the degree of coupling between the stages and thus the sharpness of band-pass characteristics can be adjusted by varying the thickness of the conductor rods 12, 13.

The internal space of the respective resonators in the aforesaid embodiments may, if found necessary, be filled with dielectric material so as to make the overall size of the resonant wave filter smaller.

Figure 6:
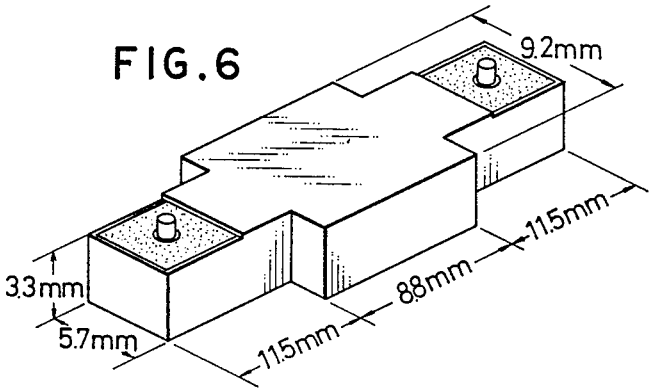
FIG. 6 is a perspective view showing the dimensions of a resonant wave filter used in an experiment.
Figure 7A:
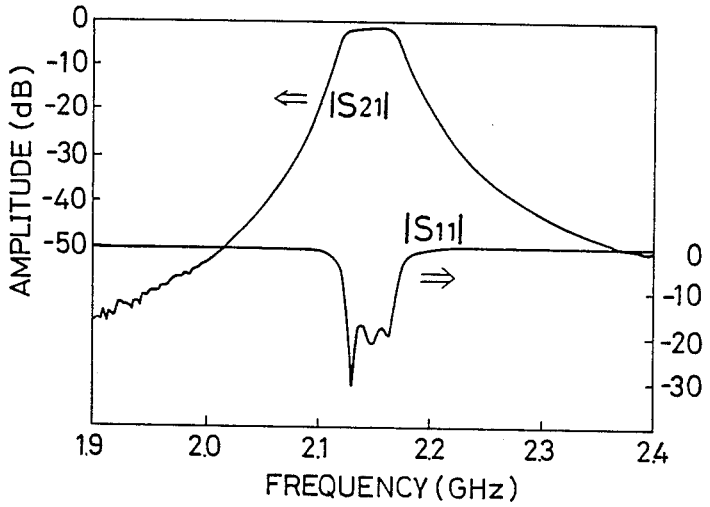
FIG. 7(*a*) is a graph showing the narrow-band response characteristics of the resonant wave filter of FIG. 6.
Figure 7B:
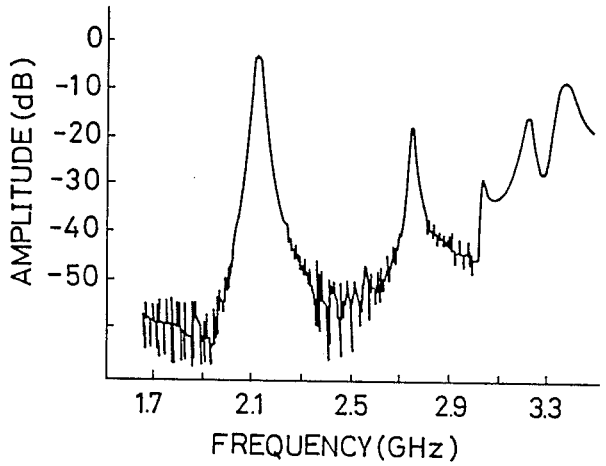

A resonant wave filter according to the embodiment shown in FIG. 1 was fabricated in the dimensions shown in FIG. 6 and was tested at a center frequency of about 2.15 GHz. The narrow-band and broadband response characteristics exhibited by the resonant wave filter are shown in FIGS. 7(*a*) and 7(*b*), respectively. As will be noted, with respect to the applied mode signal $S_{21}$ there was obtained filtering characteristics exhibiting sufficiently good shoulder characteristics. Some spurious responses are, however, seen at the higher frequency band where the cutoff regions propagate. Though the spurious responses can be moved upwards by making the cutoff waveguide narrower (and shorter so as to maintain constant coupling), this will necessitate a compromise with the increase in insertion losses.

As is clear from the foregoing explanation, the present invention provides a band-pass resonant wave filter constituted of a plurality of cascade-coupled resonators for a microwave of a desired frequency, in which coaxial resonators and waveguide resonators are used in combination so as to take advantage of the superior features of each type. As a result, the invention produces a particularly special effect in that is provides a resonant wave filter which exhibits the high Q value and thus the outstanding sharpness of band-pass wave filter characteristics desired of a microwave resonant wave filter and which, at the same time, can be realized in an extremely small size.

What is claimed is:

1. A resonant wave filter capable of selectively propagating an electromagnetic wave of a prescribed frequency comprising a TM mode resonator disposed perpendicularly to the direction of propagation of electromagnetic wave energy, a pair of TEM mode resonators disposed one on either side or said TM mode resonator in the direction of propagation of electromagnetic wave energy, and a pair of cutoff waveguides disposed one between said TEM mode resonator and each of said TM mode resonators to couple said TEM mode resonator with said TM mode resonators in evanescent mode.

2. A resonant wave filter according to claim 1 wherein said TM mode resonator is a waveguide resonator.

3. A resonant wave filter according to claim 1 wherein said TM mode resonator is a plurality of waveguide resonators.

4. A resonant wave filter according to claim 1 wherein said TEM mode resonator is a coaxial resonator.

5. A resonant wave filter according to claim 1 wherein said TEM mode resonator is a plurality of coaxial resonators.

6. A resonant wave filter according to claim 2 wherein the interior of said waveguide resonator is filled with a dielectric.

7. A resonant wave filter according to claim 4 wherein the interior of said coaxial resonator is filled with a dielectric.

8. A resonant wave filter according to claim 1 wherein the interior of said cutoff waveguide is filled with a dielectric.

* * * * *